US006176552B1

(12) United States Patent
Topka, Jr. et al.

(10) Patent No.: US 6,176,552 B1
(45) Date of Patent: Jan. 23, 2001

(54) CUTTING BIT SUPPORT MEMBER WITH UNDERCUT FLANGE FOR REMOVAL

(75) Inventors: Kenneth J. Topka, Jr., Cairnbrook; Robert H. Montgomery, Jr., Everett, both of PA (US)

(73) Assignee: Kennametal Inc., Latrobe, PA (US)

( * ) Notice: Under 35 U.S.C. 154(b), the term of this patent shall be extended for 0 days.

(21) Appl. No.: 09/166,634

(22) Filed: Oct. 5, 1998

(51) Int. Cl.[7] ..... E21C 35/18
(52) U.S. Cl. ..... 299/104; 299/79.1
(58) Field of Search ..... 299/79.1, 104, 299/106, 113

(56) References Cited

U.S. PATENT DOCUMENTS

| | | | | |
|---|---|---|---|---|
| 3,268,260 | | 8/1966 | Snipe | 299/106 |
| 3,833,265 | * | 9/1974 | Elders | 299/104 |
| 4,149,753 | | 4/1979 | Stoltz et al. | 299/106 |
| 4,251,109 | | 2/1981 | Roepke | 299/12 |
| 4,298,233 | | 11/1981 | Elfgen | 299/106 |
| 4,337,980 | | 7/1982 | Krekeler | 299/91 |
| 4,627,665 | | 12/1986 | Ewing et al. | 299/79.1 |
| 4,632,463 | | 12/1986 | Sterwerf, Jr. | 299/91 |
| 4,688,856 | | 8/1987 | Elfgen | 299/79.1 |
| 4,736,533 | | 4/1988 | May et al. | 37/141 |
| 4,938,538 | | 7/1990 | Larsson et al. | 299/104 |
| 5,018,793 | | 5/1991 | Den Besten | 299/104 |
| 5,029,944 | | 7/1991 | Komotzki | 299/91 |
| 5,374,111 | | 12/1994 | Den Besten et al. | 299/104 |
| 5,725,283 | | 3/1998 | O'Neill | 299/104 |

FOREIGN PATENT DOCUMENTS

| | | |
|---|---|---|
| 2948096 | 6/1981 | (DE) . |
| 3401243 | 8/1984 | (DE) . |
| 0521413 | 6/1992 | (EP) . |
| 0872627 | 10/1998 | (EP) . |
| 729796 | 5/1955 | (GB) . |
| 2196669 | 5/1988 | (GB) . |
| 2285464 | 12/1994 | (GB) . |

OTHER PUBLICATIONS

International Search Report for International Application No. PCT/US 99/20668, mailed Apr. 25, 2000.

Partial International Search Report for International Application No. PCT/US 99/20668, mailed Jan. 13, 2000.

* cited by examiner

*Primary Examiner*—David Bagnell
*Assistant Examiner*—John Kreck
(74) *Attorney, Agent, or Firm*—John J. Prizzi

(57) ABSTRACT

A sleeve for securing a cutting bit within a block used for mining and construction application whereby a flange on the sleeve has an undercut portion to promote removal of the sleeve. Additionally, a block used to secure a cutting bit within a holder used for mining and construction applications as a flange which also has an undercut which may be utilized with an extraction tool to promote removal of the block from the holder.

8 Claims, 4 Drawing Sheets

CUTTING BIT SUPPORT MEMBER WITH UNDERCUT FLANGE FOR REMOVAL

BACKGROUND OF THE INVENTION

1. Field of the Invention

This invention relates to a sleeve for holding a cutting bit and a block for holding a cutting bit. More particularly, this invention relates to a sleeve for holding a cutting bit and a block for holding a cutting bit in which either or both of the sleeve and the block has a flange with an undercut portion to ease removal of the sleeve and block.

2. Description of the Prior Art

Press fit or shrink fit sleeves in holding blocks for cutting bits have been common in the mining and construction industries for many years. However, one difficulty with these sleeves occurs when the sleeve is damaged or worn out and must be removed from the holding block. One method for removing such a sleeve involves cutting the sleeve out with a torch. A second method for removing the sleeve involves the use of a hydraulic cylinder and pressure device which physically forces the sleeve from the holding block. Both of these methods are slow and require extra equipment. Furthermore, both of these methods require an operator with training and experience.

U.S. Pat. No. 5,374,111, entitled "Extraction Undercut For Flange Pits" and assigned to Kennametal Inc., the assignee of the current application, addresses the use of a rotatable cutting bit, not a sleeve or holding block, having a flange with an undercut whereby the undercut may be employed in removing the rotatable cutting bit from a holder. Extracting cutting tools from holders has been a longstanding problem and it has been relatively common to employ some sort of a pulling device to physically remove a cutting bit from a holder.

However, the inventors of the subject application have realized the need for easier removal of sleeves from holding blocks.

In a related matter, the block utilized to secure a cutting bit, whether with or without an intermediate sleeve, is itself secured to a rotary tool, such as a longwall miner rotary drum, by welding it to the drum. While this provides a very secure attachment to the drum, in the event the block became damaged it is necessary then to utilize a torch to cut out the block from the drum and to replace it with a functional block. This method is also slow and requires extra equipment. Furthermore and once again, this method requires the operator to be trained and experienced. Therefore, a design is sought for the block which holds the cutting bit to promote relatively easy removal and replacement of the block in the event it becomes damaged or worn. The inventors of the subject application, therefore, have also realized the need for easier removal of the block from a holder.

SUMMARY OF THE INVENTION

In the first embodiment of the subject invention, a sleeve for retaining a cutting bit is adapted to be mounted within the bore of a block having a mating surface. The sleeve has a longitudinal axis and is comprised of a cylinder having a front end, a back end, an outside wall with a cylinder outside diameter and an inside wall with a cylinder inside diameter defining a cylinder bore extending therethrough. The cutting bit may be mounted within the cylinder bore. The sleeve also has a flange integral with and located about the cylinder at the cylinder front end. The flange has an outside wall with a flange diameter greater than the cylinder outside diameter to define a flange shoulder extending radially from the cylinder. The shoulder has a generally planar face which may contact the block mating surface. A portion of the flange is recessed within the planar face to define an undercut within the planar face of the flange shoulder.

In another embodiment, a block for retaining a cutting bit, whether directly or through an intermediate sleeve, is disclosed wherein the block is adapted to be mounted within the bore of a block holder having a mating surface. The block has a longitudinal axis and is comprised of a block cylinder having a front end, a back end, and an outside wall with a cylinder outside diameter. The block also has a block head integral with the block cylinder and located at the cylinder front end. The block head has a bore extending therein in which the cutting bit may be mounted. The block also has a block flange integral with and located about the cylinder between the cylinder back end and the head wherein the flange has an outside wall with a flange diameter greater than the cylinder outside diameter to define a flange shoulder. The flange shoulder extends radially from the cylinder and the shoulder has a generally planar face which may contact the holder planar surface. A portion of the block flange is recessed within the planar face to define an undercut within the planar face of the flange shoulder.

BRIEF DESCRIPTION OF THE DRAWINGS

Further features and other aspects of this invention will become clear from the following detailed description made with reference to the drawings in which.

DESCRIPTION OF THE PREFERRED EMBODIMENTS

Figure 1:
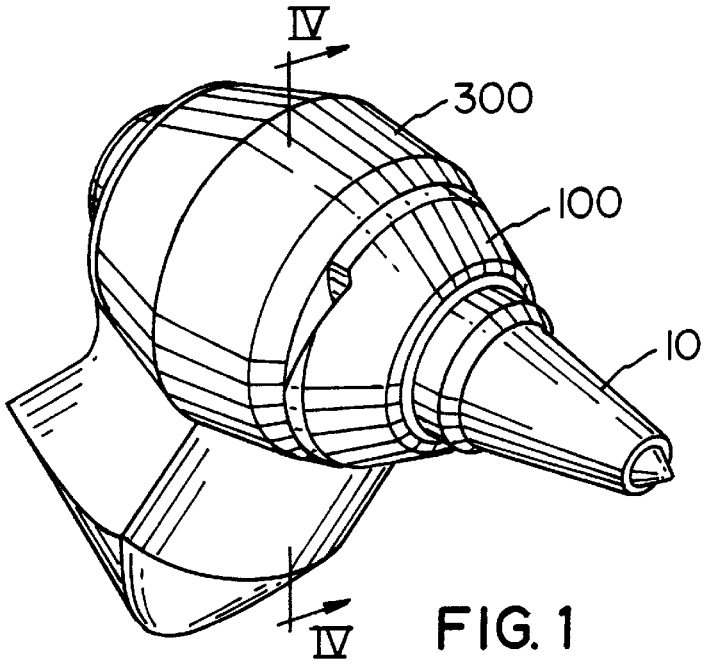
FIG. 1 is a perspective view of a cutting bit and a sleeve assembled in a block in accordance with one embodiment of the subject invention.

FIG. 1 illustrates a cutting bit 10 which is secured within a sleeve 100. The sleeve 100 is secured within a block 300 and the block 300 is secured to a rotating drum (not shown) which may be used in mining or construction applications.

Figure 2:
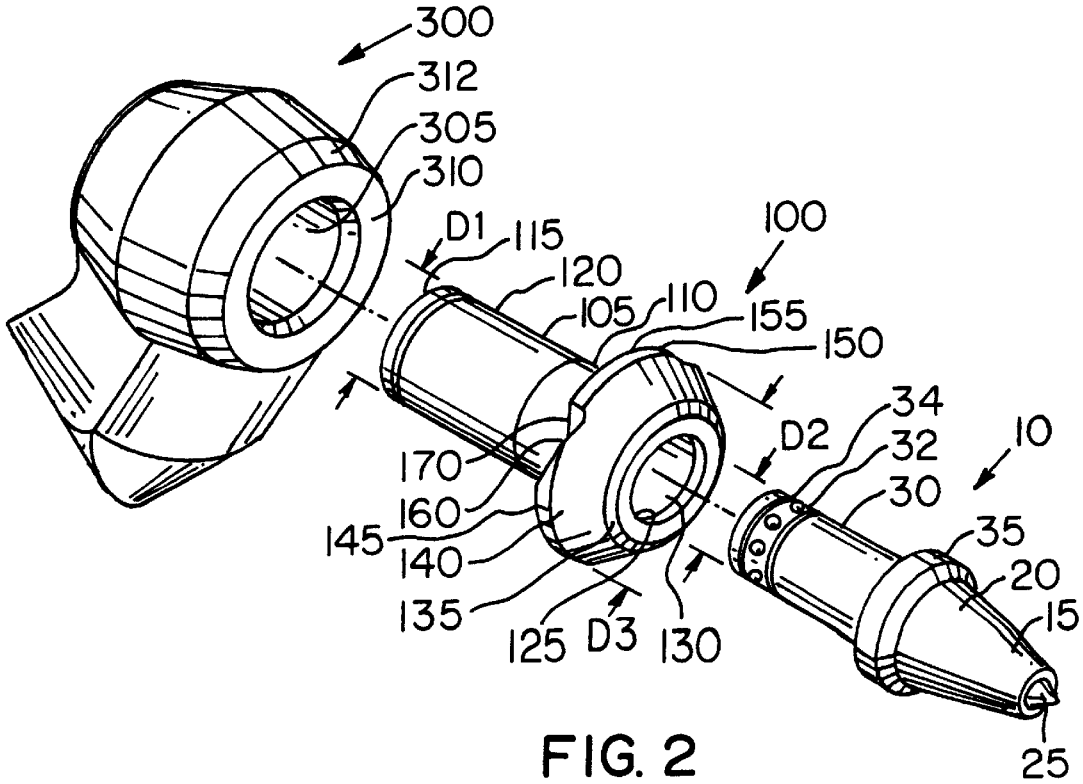
FIG. 2 is an exploded perspective view of the arrangement illustrated in FIG. 1.

FIG. 2 illustrates the same arrangement as FIG. 1, however, in an exploded perspective. The cutting bit 10 generally includes a working head 15 having a generally conically shaped nose portion 20 and a tip 25 comprised of a hard material such as cemented carbide or other material generally known in the field of mining and construction. The shank 30 of the cutting bit 10 is mounted within a bore 130 of the sleeve 100 and secured therein by a retainer clip 32, which is recessed within a groove 34 in the shank 30. The flange 35 on the cutting bit 10 rests against a mating face 135 of the sleeve flange 140.

The sleeve 100 is adapted to be mounted within the bore 305 of the block 300 and against a mating surface 310 on the block 300. The sleeve 100 is comprised of a cylinder 105 having a front end 110 and a back end 115. The cylinder 105 also has an outside wall 120 with a cylinder outside diameter D1 and an inside wall 125 with a cylinder inside diameter D2 defining the cylinder bore 130 extending therethrough.

The cylinder 105 of the sleeve 100 may be secured within the bore 305 of the block 300 in a variety of different ways. The cylinder 105 may be press fit or shrunk fit into the bore 305. As another alternative, the cylinder 105 and the bore 305 may be slightly tapered to provide a Morse self-sticking taper between the cylinder 105 and the bore 305. The flange 140 is integral with the cylinder 105 and located about the cylinder 105 at the front end 110. The flange 140 has an outside wall 145 with a flange diameter D3 greater than the cylinder outside diameter D1 to define a flange shoulder 150 extending radially from the cylinder 105. The shoulder 150 has a generally planar face 155 (FIG. 3) which may contact the block mating surface 310.

Figure 3:
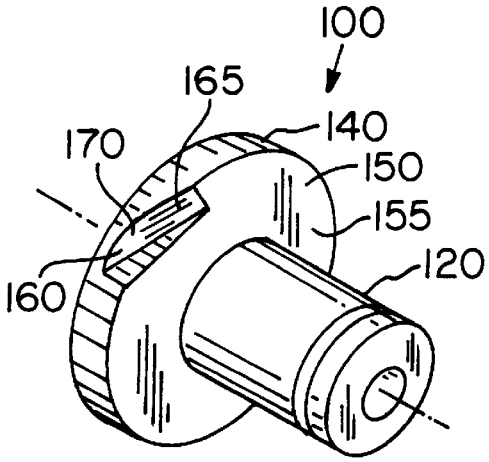
FIG. 3 is a perspective view of the sleeve illustrated in FIG. 2 but taken viewing the back of the sleeve.
Figure 4:
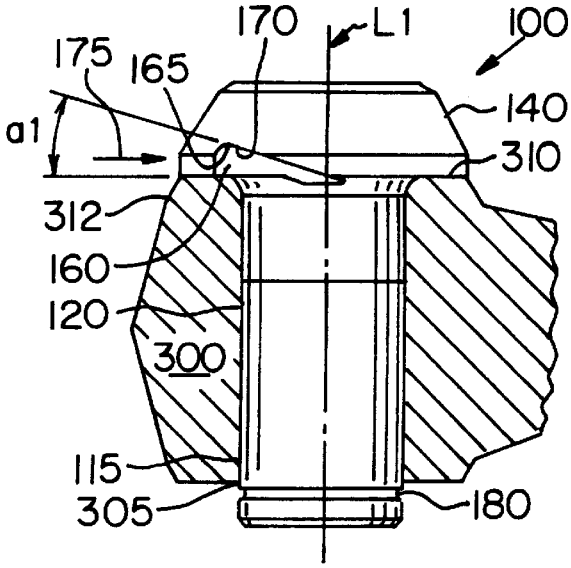
FIG. 4 is a side view of the sleeve illustrated in FIG. 1 with the cutting bit removed and the block shown in partial cross section and taken along arrows IV—IV in FIG. 1.

As illustrated in FIGS. 3 and 4, a portion of the flange 140 is recessed within the shoulder planar face 155 to define an undercut 160 within the planar face 155 of the flange shoulder 150. The undercut 160 within the planar face 155 has a top surface 165 which defines a plane.

The top surface 165 of the undercut 160 may define an incline 170 which, as illustrated in FIG. 4, extends generally tangentially toward the cylinder outside wall 120 and upwardly from a longitudinal axis L1 extending through the center of the sleeve 100. The incline 170 forms an angle (a1) with a line extended from a plane defined by the shoulder face 155. The angle (a1) may be between 1° and 45° and preferably is approximately 14°.

To remove the sleeve 100, a wedging tool (not shown) is inserted in the direction illustrated by arrow 175 in FIG. 4 to engage the incline 170. It should be noted the incline 170 may extend beyond the longitudinal axis L1 of the sleeve 100. While it is possible to extend the incline 170 so that it does not extend beyond the longitudinal axis L1, such an extension beyond the longitudinal axis L1 permits the wedging tool to apply an extraction force along the centerline of the sleeve, thereby minimizing uneven forces against the incline 170 that may tend to jam the sleeve 100 within the bore 305 of the block 300.

Utilizing an arrangement similar to that illustrated in FIG. 4, a tool engaging the incline 170 and inserted from the side at an angle (a1) of 14° provides a mechanical advantage of approximately 4:1. Therefore, a wedge driven with a relatively modest hammer impact force of 2,300 to 3,000 pounds will produce a vertical force upon the sleeve 100 of between 7,000 to 12,000 pounds. A standard wedge tool known in the industry may be utilized for such an application.

Although the shape of the surface 310 of the block 300 illustrated in FIG. 2 is planar, it is possible to utilize a variety of other shapes for this surface. The wedging tool must have a support base upon the block 300 to be, for the wedging tool, an opposing surface for generating an extraction force on the sleeve 100. Therefore, the surface 310 of the block may be any shape capable of providing such a support base to the wedging tool. As an example, the conical portion 312 immediately behind the surface 310 in FIG. 2 could be extended to provide a thin circular lip (not shown). In this instance, the outer diameter of the lip must be incrementally greater than the diameter of the sleeve 100 to provide a surface upon which the wedging tool could be supported.

Furthermore, as shown in FIG. 4, the sleeve 100 has a groove 180 near its back end 115. A clip (not shown) may be used within the groove 180 to provide a redundant system for holding the sleeve 100 within the block bore 305.

Figure 5:
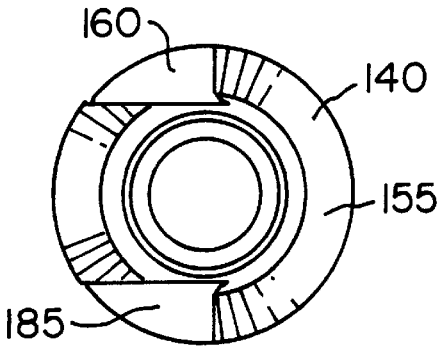
FIG. 5 is a view from the underside of the sleeve in FIG. 4.

The discussion so far has been focused upon only a single incline 170. While this may be suitable to remove the sleeve 100 from the block 300, FIG. 5 illustrates a bottom view of the sleeve illustrated in FIG. 5 which further includes a second portion in the flange 140 which is recessed from the planar face 155 to form a second undercut 185 radially opposed to the original undercut 160. While the incline 170 of undercut 160 promotes removal of the sleeve 100 from the block 300, the radially opposed undercuts 160 and 185 promote uniform forces to more effectively remove the sleeve 100 from the block 300.

Figure 6:
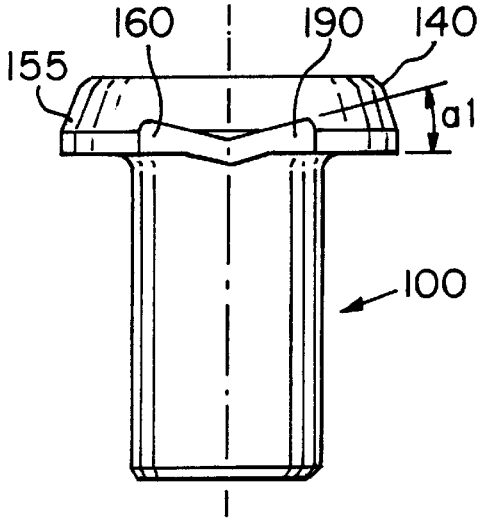
FIG. 6 is a modification of the sleeve illustrated in FIG. 4 in accordance with a second embodiment of the subject invention.

FIG. 6 illustrates an arrangement whereby undercut 190 is positioned within the flange shoulder 155 at a tangentially opposite location from the initial undercut 160. In this manner, a tool for removing the sleeve 100 may be inserted from either side of the flange 140. It should be appreciated that both undercuts 160 and 190 may have opposing undercuts, similar to undercuts 160 and 185 in FIG. 5, to provide two pairs of undercuts.

Figure 7:
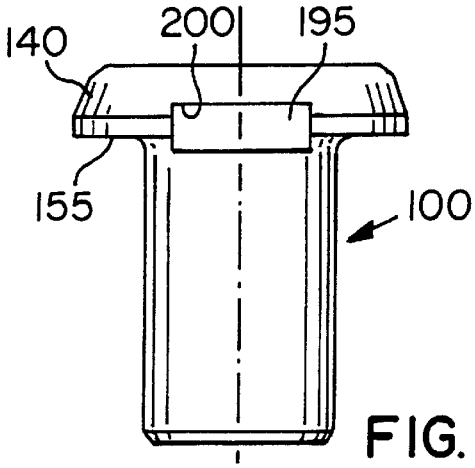
FIG. 7 is a modification of the sleeve illustrated in FIG. 4 in accordance with a third embodiment of the subject invention.

In yet another embodiment, a sleeve 100 with a shoulder 155 has an undercut 195 as illustrated in FIG. 7. The undercut 195 has a top surface 200 which is spaced from and parallel to the shoulder planar surface 155. A similar undercut may exist radially opposite undercut 195 to provide a pair of undercuts.

Figure 8:
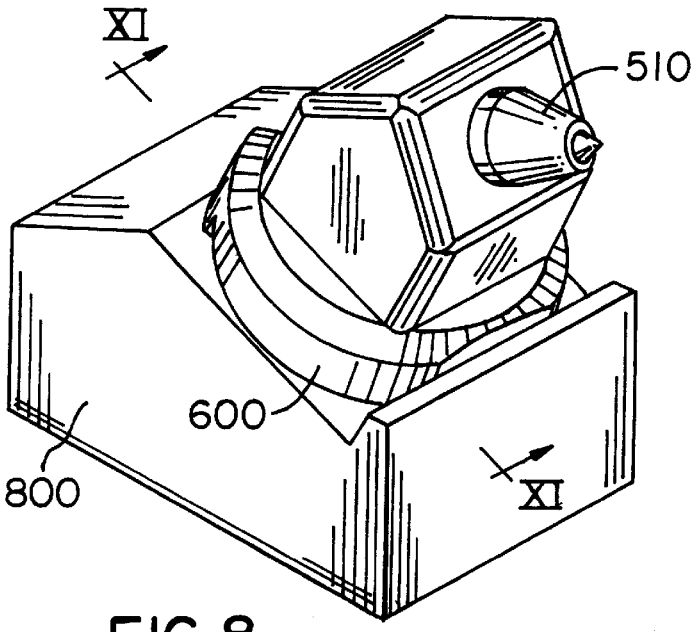
FIG. 8 is a perspective view of a cutting bit and block assembled in a holder in accordance with a fourth embodiment of the subject invention.
Figure 9:
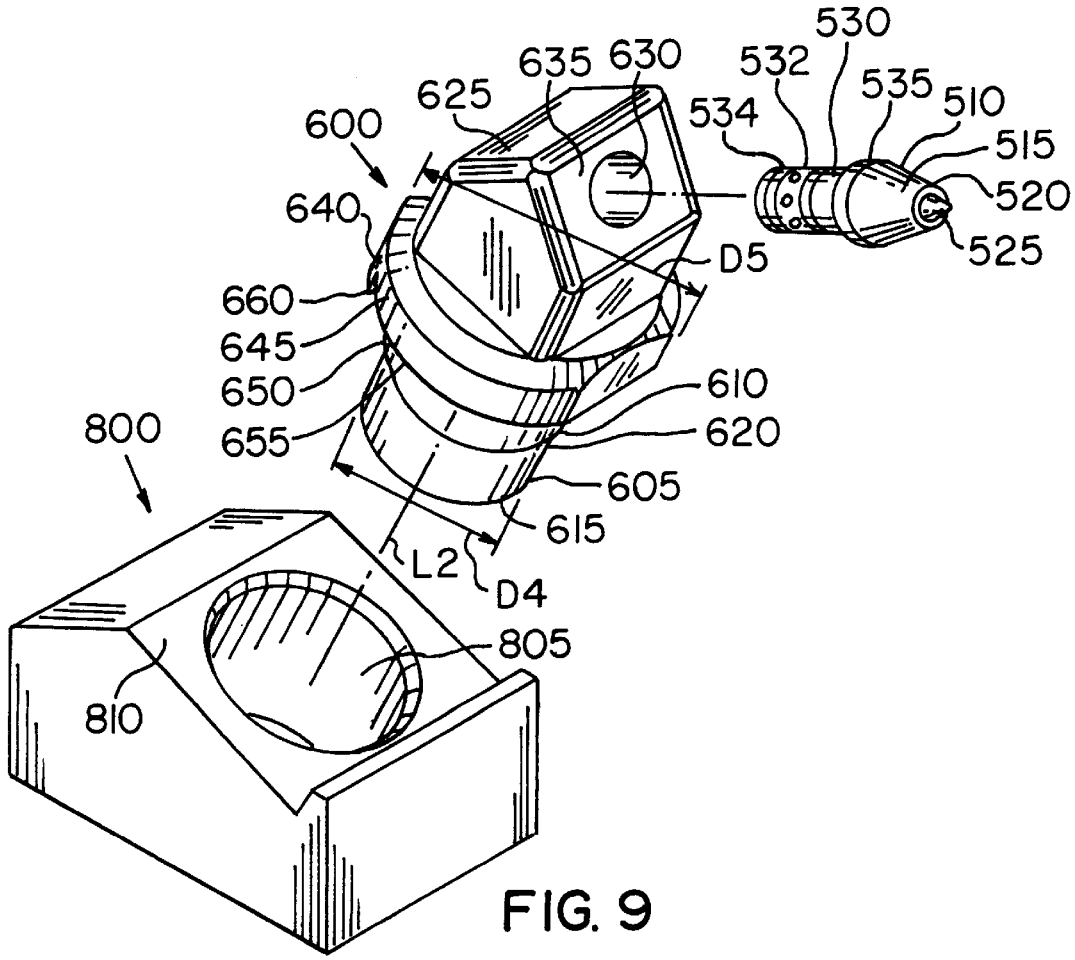
FIG. 9 is an exploded perspective view of the arrangement illustrated in FIG. 8.

The invention discussed so far has been applied to a sleeve mounted within the block illustrated in FIGS. 1 and 2. In these instances the block is typically secured directly through welding to a device such as a rotary drum. As illustrated in FIGS. 8 and 9, it is possible to apply the aforementioned concept to a block as it is secured within a holder on, for example, a rotating drum.

FIG. 8 illustrates a cutting bit 510 which is secured within a block 600. The block 600 is secured within a block holder 800, and the block holder 800 is secured within a rotating drum (not shown) which may be used in mining or construction applications.

FIG. 9 illustrates the same arrangement as FIG. 8, however, illustrated in an exploded perspective view. The cutting bit 510 generally includes a working head 515 having a generally conically shaped nose portion 520 and a tip 525 comprised of a hard material such as cemented carbide or other material generally known in the field of mining and construction. The shank 530 of the cutting bit 510 is mounted within a bore 630 of the block 600 and secured therein by a retainer clip 532, which is recessed within a groove 534 in the shank 530. The flange 535 on the cutting bit 510 rests against a mating face 635 of the block 600.

It should be noted in the embodiment illustrated in FIGS. 1 and 2, the cutting bit 10 was secured within the sleeve 100 which was then secured within the block 300. As illustrated in FIGS. 8 and 9, it is possible to mount the cutting bit 510 directly within the block 600 without the use of an intermediate sleeve. However, while not shown in FIGS. 8 and 9, the cutting bit 510 may be mounted in a sleeve, such as 300 in FIG. 2, and the sleeve 300 may be mounted within the block 600. Furthermore, the sleeve 300 may utilize the same undercut design illustrated in FIG. 2 such that both the block 600 and the sleeve mounted within the block 600 have undercuts for easy removal.

The block 600 is adapted to be mounted within the bore 805 of the block holder 800 and against a mating surface 810 on the holder 800. The block 600 is comprised of a block cylinder 605 having a front end 610 and a back end 615. The cylinder 605 also has an outside wall 620 with a cylinder outside diameter D4. A block head 625 is integral with the block cylinder 605 at the cylinder front end 610 and the bore 630 extends therein. The flange 535 of the cutting bit 510 may rest against the surface 635 of the block head 625.

The cylinder 605 of the block 600 may be secured within the bore 805 of the holder 800 in a variety of different ways. The cylinder 605 may be press fit or shrunk fit into the bore 805. As another alternative, the cylinder 605 and the bore 805 may be slightly tapered to provide a Morse self-sticking taper between the cylinder 605 and the bore 805.

A block flange 640 is integral with the cylinder 605 and located about the cylinder 605 between the cylinder back end 615 and the head 625. The flange 640 has an outside wall 645 with a flange diameter D5 greater than the cylinder outside diameter D4 to define a flange shoulder 650 extending radially from the cylinder 605. The shoulder 650 has a generally planar face 655 (FIG. 10) which may contact the holder mating surface 810.

Figure 10:
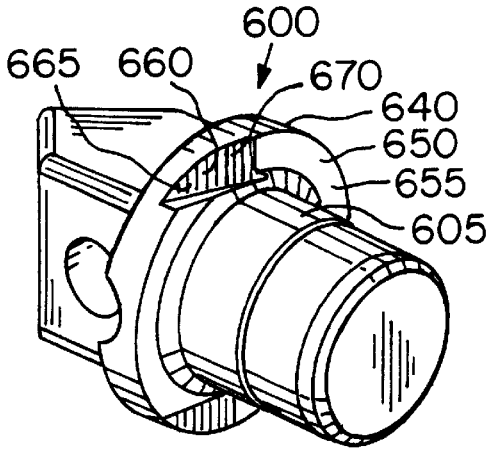
FIG. 10 is a perspective view of the block illustrated in FIG. 9 but taken viewing the back of the block.
Figure 11:
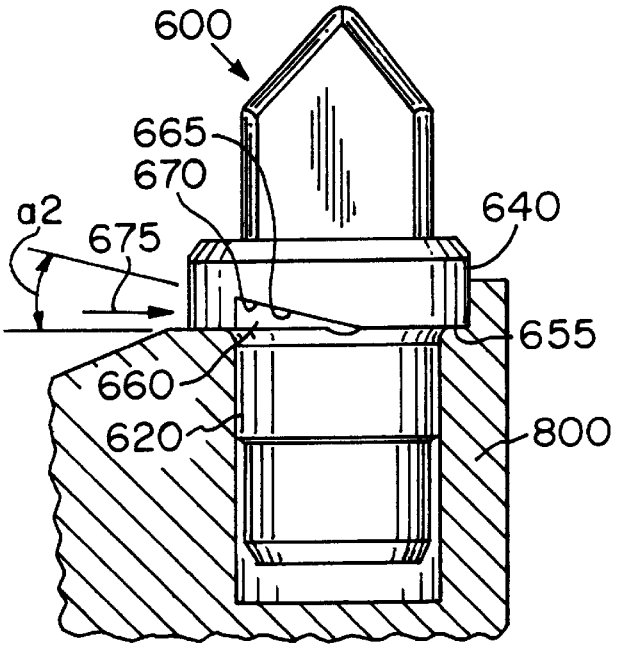
FIG. 11 is a side view of the block illustrated in FIG. 8 with the cutting bit removed and the holder shown in partial cross section taken along arrows XI—XI in FIG. 8.

As illustrated in FIGS. 10 and 11, a portion of the block flange 640 is recessed within the shoulder planar face 655 to define an undercut 660. The undercut 660 within the planar face 655 has a top surface 665 which defines a plane.

The top surface 665 of the undercut 660 may define an incline 670 which, as illustrated in FIG. 11, extends generally toward the cylinder outside wall 620 and upwardly from the longitudinal axis L2 extending through the center of the block 600. The incline 670 forms an angle (a2) with a line extended from a plane defined by the shoulder face 655. The angle (a2) may be between 1° and 45° and preferably is approximately 14°.

To remove the block 600, a wedging tool (not shown) is inserted in the direction illustrated by arrow 675 in FIG. 11 to engage the incline 670. It should be noted the incline 670 may extend beyond the longitudinal axis L2 of the block 600. While it is possible to extend the incline 670 so that it does not extend beyond the longitudinal axis L2, such an extension beyond the longitudinal axis L2 permits the wedging tool to apply an extraction force along the centerline of the block 600, thereby minimizing uneven forces against the incline 670 that may tend to jam the block 600 within the bore 805 of the holder 800.

Utilizing an arrangement similar to that illustrated in FIG. 11, a tool engaging the incline 670 and inserted from the side at an angle a2 of 14° provides a mechanical advantage of approximately 4:1. Therefore, a wedge driven with a relatively modest hammer impact force of 2,300 to 3,000 pounds will produce a vertical force upon the block 600 of between 7,000 to 12,000 pounds. A standard wedge tool known in the industry may be utilized for such an application.

Although the shape of the surface 810 of the holder 800 illustrated in FIG. 9 is planar, it is possible to utilize a variety of other shapes for this surface. The only requirement is to have a support base upon the holder 800 to be, for the wedging tool, an opposing surface for generating an extraction force on the block 600.

Figure 12:
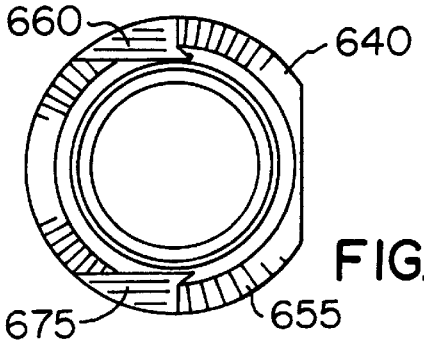
FIG. 12 is a view of the underside of the block in FIG. 11.

The discussion of the embodiment illustrated in FIGS. 8 and 9 so far has been focused only upon a single incline 670. While this may be suitable to remove the block 600 from the holder 800, FIG. 12 illustrates a bottom view of the block 600 illustrated in FIG. 11 which further includes a second portion of the flange 640 which is recessed from the planar face 655 to form a second undercut 675 radially opposed to the original undercut 660. While the incline 670 of the undercut 660 promotes removal of the block 600 from the holder 800, the radially opposed undercuts 660 and 675 promote uniform force to efficiently remove the block 600 from the holder 800.

Figure 13:
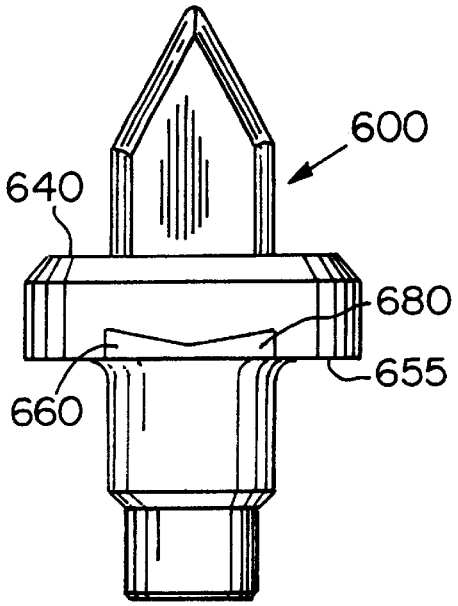
FIG. 13 is a modification of the block illustrated in FIG. 11 in accordance with a fifth embodiment of the subject invention.

FIG. 13 illustrates an arrangement whereby an undercut 680 is positioned within the flange shoulder 655 at a tangentially opposite location from the initial undercut 660. In this manner a tool for removing the block 600 may be inserted from either side of the flange 640. It should be appreciated that both undercuts 660 and 680 may have opposing undercuts, similar to those undercuts 660 and 675 in FIG. 12, to provide two pairs of undercuts.

Figure 14:
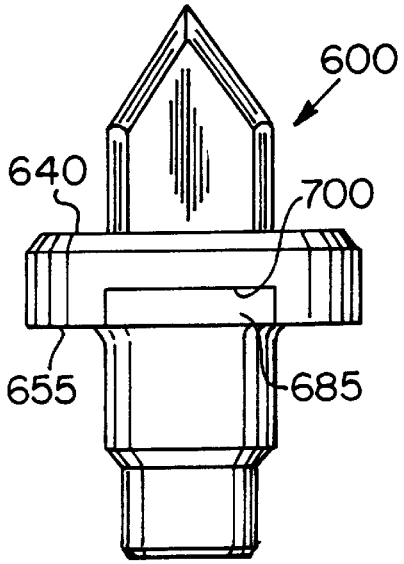
FIG. 14 is a modification of the side view illustrated in FIG. 11 in accordance with a sixth embodiment of the subject invention.

In a final embodiment, an undercut 685 as illustrated in FIG. 14 has a top surface 700 which is spaced from and parallel to the shoulder planar surface 655.

The present invention may, of course, be carried out in other specific ways other than those herein set forth without departing from the spirit and the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A sleeve for retaining a cutting bit, wherein the sleeve is adapted to be interference fitted within a bore of a block having a mating surface, the sleeve having a longitudinal axis and comprising:

a) a cylinder having a front end and a back end and having an outside wall with a cylinder outside diameter and an inside wall with a cylinder inside diameter defining a cylinder bore extending therethrough, wherein the cutting bit may be mounted within the cylinder bore and wherein the block bore has a bore diameter and wherein the cylinder outside diameter is greater than the bore diameter to provide an interference fit between the block bore and the cylinder;

b) a flange integral with and located about the cylinder at the cylinder front end, the flange having an outside wall with a flange diameter greater than the cylinder outside diameter to define a flange shoulder extending radially from the cylinder and the shoulder having a planar face which may contact the block mating surface, wherein the flange has a first diametrical line and a second diametrical line perpendicular thereto;

c) wherein portions of the flange are recessed within the planar face to define a pair of undercuts within the planar face of the flange shoulder; and d) wherein the undercuts are diametrically opposed to one another with respect to the first diametrical line and wherein each undercut has a top surface defining a plane which is inclined downwardly from the flange outside wall with respect to the second diametrical line such that the lowest point of the undercut occurs at or beyond the longitudinal axis of the sleeve, thereby defining an angle (a1) between the plane of the undercut and the shoulder planar face.

2. The sleeve according to claim 1 wherein the angle (a1) is between 1°–45°.

3. The sleeve according to claim 2 wherein the angle (a1) is 14°.

4. The sleeve according to claim 1 further including an additional pair of undercuts positioned in the flange shoulder at diametrically opposite locations from the first pair of undercuts.

5. A block for retaining a cutting bit, wherein the block is adapted to be interference fitted within a bore of a block holder having a mating surface, the block having a longitudinal axis and comprising:

a) a block cylinder having a front end and a back end and having an outside diameter, wherein the block holder has a bore diameter and wherein the cylinder outside diameter is greater than the bore diameter to provide an interference fit between the block holder bore and the block cylinder;

b) a block head integral with the block cylinder and located at the cylinder front end, wherein the block head has a bore extending therein in which a cutting bit may be mounted;

c) a block flange integral with and located about the cylinder between the cylinder back end and the head wherein the flange has an outside wall with a flange diameter greater than the cylinder outside diameter to define a flange shoulder extending radially from the cylinder and the shoulder having a generally planar face which may contact the holder mating surface, wherein the flange has a first diametrical line and a second diametrical line perpendicular thereto;

d) wherein portions of the block flange are recessed within the planar face to define a pair of undercuts within the planar face of the flange shoulder; and e) wherein the undercuts are diametrically opposed to one another with respect to the first diametrical line and wherein each undercut has a top surface defining a plane which is inclined downwardly from the flange outside wall with respect to the second diametrical line such that the lowest point of the undercut occurs at or beyond the longitudinal axis of the block, thereby forming an angle (a2) between the plane of the undercut and the shoulder planar face.

6. The block according to claim 5 wherein the angle (a2) is between 1°–45°.

7. The block according to claim 6 wherein the angle (a2) is 14°.

8. The block according to claim 5 further including an additional pair of undercuts positioned in the block flange shoulder at diametrically opposite locations from the first pair of undercuts.

* * * * *